United States Patent [19]

Halmasy, Sr.

[11] 4,454,981

[45] Jun. 19, 1984

[54] MECHANISM FOR A NEWSPAPER DELIVERY BOX FOR INDICATING DELIVERY OF A ROLLED NEWSPAPER

[76] Inventor: Lawrence G. Halmasy, Sr., 1747 Swartz Rd., Suffield, Ohio 44260

[21] Appl. No.: 258,319

[22] Filed: Apr. 27, 1981

Related U.S. Application Data

[63] Continuation of Ser. No. 67,627, Aug. 17, 1979, abandoned.

[51] Int. Cl.[3] ..... B65D 91/00

[52] U.S. Cl. ..... 232/1 C; 232/34

[58] Field of Search ..... 232/1 C, 34

[56] References Cited

U.S. PATENT DOCUMENTS 1,904,448 9/1930 Hampden et al. ..... 232/34

2,496,962 2/1950 Shaw ..... 232/1 C

*Primary Examiner*—Gene Mancene

*Assistant Examiner*—Cary E. Stone

[57] ABSTRACT

A mechanism to be inserted into a newspaper delivery box for indicating when a newspaper has been delivered having a newspaper contacting means attached to lever arm which transmits torque through pivot shaft to move lever arm to raise flag.

2 Claims, 3 Drawing Figures

MECHANISM FOR A NEWSPAPER DELIVERY BOX FOR INDICATING DELIVERY OF A ROLLED NEWSPAPER

This is a continuation of application Ser. No. 067,627 filed Aug. 17, 1979, now abandoned.

The invention relates to a newspaper delivery box having a means to indicate delivery of a rolled newspaper.

Newspaper delivery boxes make it possible for newspapers to be delivered easily by car in bad weather. The box is positioned on the side of the road and the delivery person merely takes a rolled up newspaper in his hand, reaches his hand out through an open window of his car and inserts the rolled up newspaper into the newspaper delivery box. This method of delivery is quite convenient for the delivery person, particularly during rain or snow. Unfortunately the person to whose box the paper has been delivered has no way of knowing that delivery has taken place other than by checking the box. During rain or snow when the delivery person is late, several trips may be made by a person to determine if a newspaper has been delivered. One prior art attempt to remedy the problem involved putting a glass window in the back side of the newspaper delivery box. The glass was often broken with the result that newspapers in the box got wet during rain storms.

The invention as claimed is intended to provide a remedy. It solves the problem of lack of indication when a newspaper has been delivered. The invention operates as follows. The insertion of a newspaper into the delivery box puts a force on one end of a pivoted lever positioned inside of the box. The force causes the lever to move. The force and motion is transmitted through the pivot to a second lever arm positioned outside of the box. The second lever arm has a flag attached to it which flag is raised by the motion of the second lever arm.

The advantages of the invention are that a single integral piece of bent wire having a flag attached to one end is all that is needed to convert an ordinary newspaper delivery box, to a box which indicates delivery. One or two holes are formed in the box to act as pivot points.

One way of carrying out the invention is described in detail below with reference to drawings which illustrate only one specific embodiment, in which.

Figure 1:
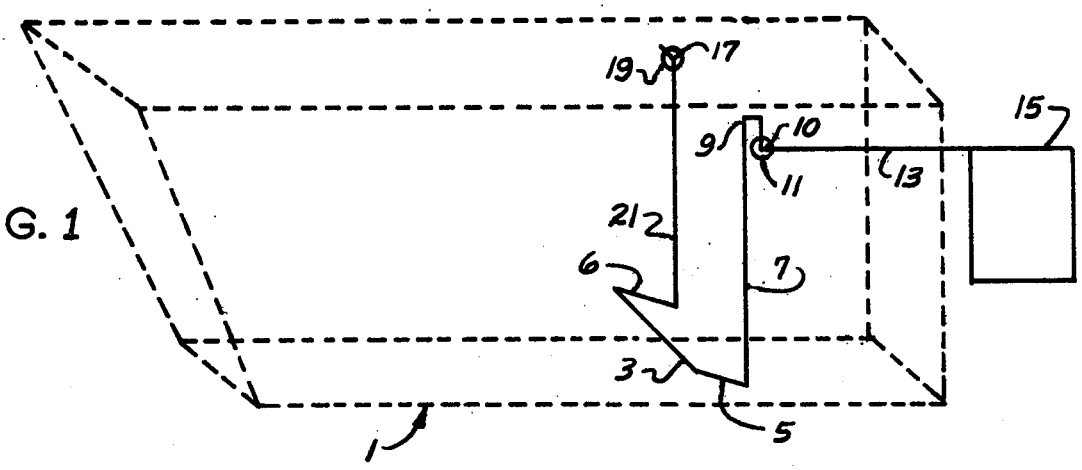
FIG. 1 is a side view of the indicator mechanism shown in solid line positioned in a paper delivery box shown in broken line.
Figure 2:
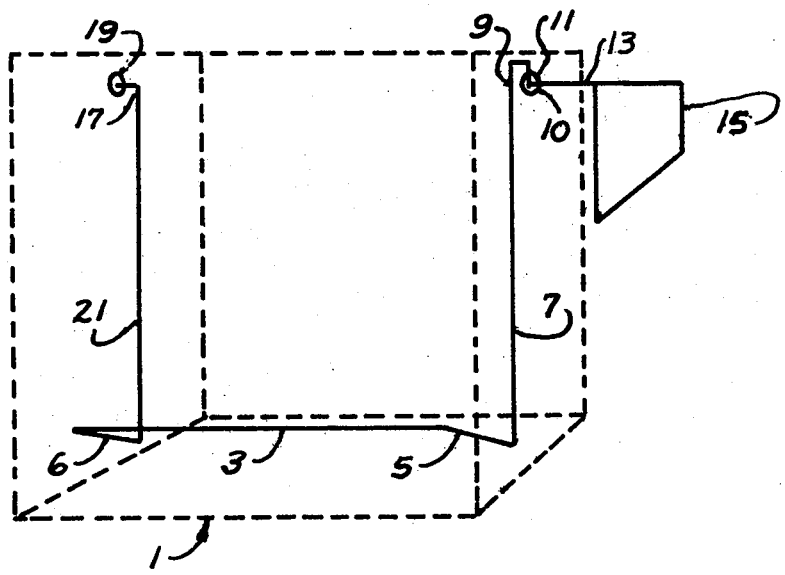
FIG. 2 is a front view corresponding to FIG. 1.
Figure 3:
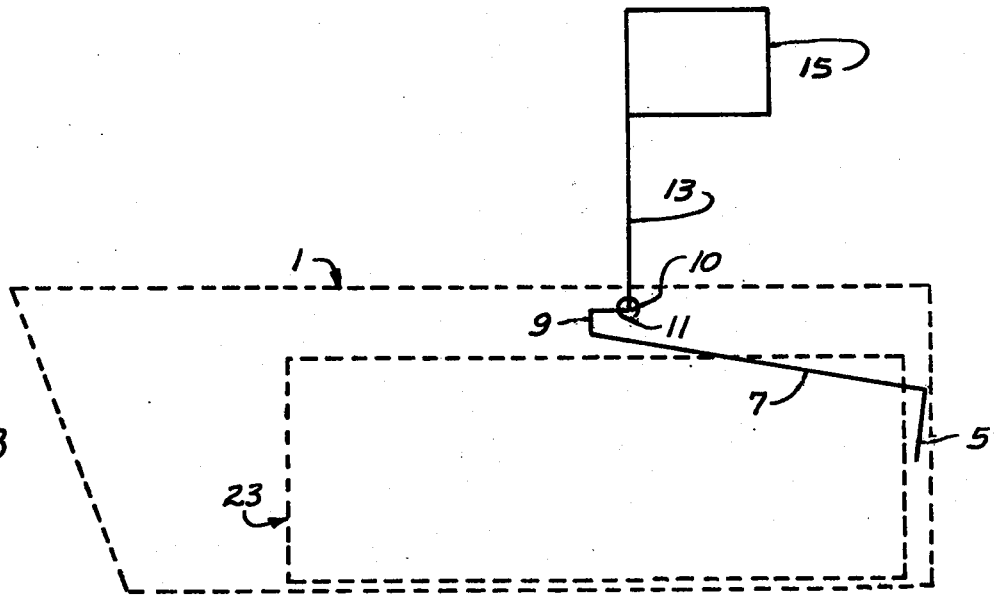
FIG. 3 is a side view corresponding to FIG. 1 with a newspaper shown in broken line inserted.

The figures show a newspaper delivery box having a delivery indicating mechanism attached thereto comprising in its basic design a newspaper delivery box 1, a newspaper contacting member 3 attached or integral to an angled portion 5 of lever arm 7.

A bend 9 in lever arm 7 limits the rotation of pivot shaft 10 through bushing 11 so as to maintain newspaper contacting member 13 in a position where it cannot be missed by an inserted newspaper and to retain lever arm 13 in a horizontal position and flag 15 in a lowered position. On the opposed side of the box, 6 corresponds to 5, 21 to 7, 17 to 10 and 19 to 11. When a newspaper 23 is inserted into the box 1 it contacts member 3 moving member 3 to a rearward position causing lever arm 7 to turn pivot shaft 10 which causes lever arm 13 to raise flag 15, thus indicating delivery.

The entire indicating mechanism can be formed from a wire with a flag attached. Preferable the wire is galvanized steel, but it can be made of steel or any other wire. To construct the device, the wire lever arm 13 first is threaded through bushing 11, then shaft 17 is placed in bushing 19 and flag 15 is then attached to lever arm 13. The wire can also be replaced with molded plastic. The angled portion 5 of lever arm 7 is very important as it allows contacting member 3 to remain in contact with the newspaper even when the newspaper is fully inserted and lever arm 7 is at or past vertical position. The box is preferably plastic and is preferably made with bushing holes molded into it, but the bushing holes can be drilled or melted. Also the holes can act as bushings but preferably bushing inserts are employed. For ease of insertion the bushings may have a slot cut through one wall to the center opening. This will allow the wire to be inserted into the box then the bushings can be placed around the pivots of the wire and inserted into the holes in the box.

Other embodiments of the invention include a side box having limit mechanism for flag movement, attached to the newspaper delivery box. In addition, the flag raising mechanism can be attached to the newspaper box by a clip. The activated mechanism being deep in the box and activating the flag raising mechanism at the front of the box by a cable or string. The preferred invention however is as described in detail and shown in the drawings.

In addition to being made of cloth, the flag can be made of plastic or metal or any other material which can be seen at a distance.

The term newspaper box includes any box into which a rolled up newspaper or rolled up magazine are inserted. Rolled up means rolled into a complete cylinder or semi or partial cylinder.

I claim:

1. A mechanism attached to a newspaper delivery box to indicate when a newspaper is delivered, the mechanism comprising a contact member of a rigid material forming an integral assembly at least one first lever arm attached to at least one second lever arm through a pivot mounted near the rear of the box; wherein said contact member is moved when a newspaper is inserted, the contact member being integral to the first lever arm which is positioned inside of the box, the first lever arm being near the rear of the box and transmitting force to move the second lever arm positioned outside of the box, an indicating means attached to the second lever arm outside of the box, the indicating means being activated by movement of the contact member to rise up and indicate that a newspaper has been inserted into the box; the improvement comprising the first lever arm inside of the box having a bend, which defines a forwardly angled portion, the first lever arm extending downwardly from the pivot then angled forwardly, with respect to the position the first lever arm would have been in in the absence of the bend, to the contact member, so that when a newspaper is inserted, one end of the paper contacts the contact member and moves it to the rear of the box, thus rotating the lever arm and raising the indicating means, without the newspaper going beyond or past the contact member.

2. The mechanism of claim 1 further characterized by the mechanism being integral and one piece, except for the flag.

* * * * *